US007905577B2

(12) United States Patent
Takeuchi et al.

(10) Patent No.: US 7,905,577 B2
(45) Date of Patent: Mar. 15, 2011

(54) PRINTHEAD SUBSTRATE HAVING ELECTROTHERMAL TRANSDUCERS ARRANGED AT HIGH DENSITY, PRINTHEAD, AND PRINTING APPARATUS

(75) Inventors: Souta Takeuchi, Yokohama (JP); Yoshiyuki Imanaka, Kawasaki (JP); Koichi Omata, Kawasaki (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 598 days.

(21) Appl. No.: 11/953,669

(22) Filed: Dec. 10, 2007

(65) Prior Publication Data

US 2008/0143789 A1 Jun. 19, 2008

(30) Foreign Application Priority Data

Dec. 15, 2006 (JP) ..... 2006-338095

(51) Int. Cl.
*B41J 2/05* (2006.01)

(52) U.S. Cl. ..... 347/56; 347/58

(58) Field of Classification Search ..... 347/9, 12–13, 347/40, 42, 50, 56–59
See application file for complete search history.

(56) References Cited

U.S. PATENT DOCUMENTS

| | | | | |
|---|---|---|---|---|
| 5,121,143 | A * | 6/1992 | Hayamizu | 347/63 |
| 5,754,201 | A | 5/1998 | Ishinaga | |
| 6,137,502 | A | 10/2000 | Anderson | |
| 6,149,265 | A * | 11/2000 | Watanabe | 347/58 |
| 6,409,315 | B2 | 6/2002 | Komuro | |
| 6,474,790 | B2 | 11/2002 | Kaneko | |
| 6,890,048 | B2 * | 5/2005 | Hirayama | 347/12 |
| 6,966,629 | B2 | 11/2005 | Nakajima | |

FOREIGN PATENT DOCUMENTS

JP 2002-374163 12/2002

* cited by examiner

*Primary Examiner* — Juanita D Stephens
(74) *Attorney, Agent, or Firm* — Canon USA Inc IP Div

(57) ABSTRACT

Plural electrothermal transducers (heaters) belonging to each of blocks having different driving timings are constituted as one group and are connected to a common interconnecting wiring in units of one group. Plural lines are connected to the common wiring such that the plural lines are extended to return with respect to the heaters and are each arranged to extend in an adjacent or sandwiched relation to the heaters. A printhead substrate, a printhead, and a printing apparatus can be provided which can realize higher quality of a printed image and a higher printing speed by arraying the heaters at a higher density while ensuring a sufficient area for arrangement of each of the heaters.

10 Claims, 12 Drawing Sheets

PRINTHEAD SUBSTRATE HAVING ELECTROTHERMAL TRANSDUCERS ARRANGED AT HIGH DENSITY, PRINTHEAD, AND PRINTING APPARATUS

BACKGROUND OF THE INVENTION

1. Field of the Invention

The present invention relates to a printhead substrate including electrothermal transducers (heaters) to generate thermal energy for discharging ink. The present invention also relates to a printhead having the printhead substrate assembled therein, and to a printing apparatus configured to print an image by using the printhead.

2. Description of the Related Art

For example, Japanese Patent Laid-Open No. 2002-374163 describes an ink jet printhead in which electrothermal transducers (heaters), a driver, and a logic circuit are formed on a silicon substrate. In accordance with image data, the logic circuit drives the electrothermal transducers through the driver. An arrangement of power supply wirings (lines) for the electrothermal transducers in a substrate (printhead substrate) is described in, e.g., U.S. Pat. No. 6,409,315.

Resolution of a color ink jet printer utilizing the thermal ink jet technique has been increased year by year. Also, in an ink jet printhead used to print an image with high quality, a density at which a plurality of discharge ports (nozzles) are arrayed to discharge ink droplets has been increased from 600 dpi (dots/inch) to 900 dpi and further to 1200 dpi per color of ink. A practical arrangement of such a printhead is described in, e.g., U.S. Pat. No. 6,474,790.

Further, the size of an ink droplet discharged from the printhead has been reduced to lessen graininess in a halftone area of a gray-scale image and an intermediate-tone or highlight area of a photographic color image. In a printhead to discharge color ink, for example, there is a tendency to reduce the droplet size year by year from an ink discharge amount of about 15 pl several years ago to 5 pl and further to 2 pl. Such a printhead is adaptable for a user's needs for higher-quality printing when the user wants to print a graphic or photographic color image with higher quality. However, when the user wants to print a relatively rough image, e.g., a color graph in business forms, which does not require high resolution, a contradiction to the demand for higher-speed printing is resulted because the number of scans necessary for printing is increased due to the reduction of the droplet size.

With the view of solving such a problem, a printhead has been proposed which has both features of higher-quality printing realized with the reduction in size of the discharged ink droplet and a higher-speed printing using the ink droplet of a larger size. For example, U.S. Pat. No. 5,754,201 proposes a method of arranging a plurality of electrothermal transducers in one nozzle and modulating an ink discharge amount. As another example, U.S. Pat. No. 6,137,502 proposes a method of arranging, in one printhead substrate, a plurality of discharge ports (nozzles) which have different ink discharge amounts from each other.

In addition, a method of transferring image data having an increased data quantity to a printhead and driving the printhead in a more compact way is proposed as a time-division driving method in U.S. Pat. No. 6,966,629, for example. With the proposed time-division driving method, a plurality of adjacent electrothermal transducers (heaters) are set as one group and the electrothermal transducers (heaters) in the group are driven successively on the time basis such that plural one of the electrothermal transducers in each group are not driven at the same time.

In recent ink jet printers (ink jet printing apparatuses), as described above, the droplet size of the discharged ink has been reduced to obtain an image with higher quality. On the other hand, a higher printing speed has also been demanded. When the same image is simply formed, the same ink amount is required. For example, when the amount of the ink droplet is reduced to ½ just by decreasing the droplet size of the discharged ink, the printing speed is also reduced to ½. In that case, the reduction of the printing speed can be avoided by discharging the ink in the same amount toward a printing medium. To realize it, however, the number of heaters (electrothermal transducers) arranged per unit length of a nozzle array has to be doubled. If the number of heaters is doubled while the pitch between two adjacent heaters is kept the same, the size of a printhead substrate in which the heaters are arranged is increased by two folds or more. The so-called serial scanning printing apparatus, in particular, suffers from drawbacks of increasing the size of the printhead which is moved in the apparatus at a high speed, making production more difficult, increasing the size of the printing apparatus, and generating larger vibration and noise. To avoid those drawbacks, it is necessary to reduce the heater pitch and to array the heaters at a higher density.

On the other hand, from the viewpoint of stably discharging the ink droplets, a stable voltage has to be applied to the heaters. If all the heaters are driven at the same time, large current flows at a time and a large voltage drop is caused due to the line resistance. As one example of proposals to avoid such a large voltage drop, a time-division driving method is employed which limits the number of heaters driven at the same time and drives the grouped heaters successively at different timings.

Because the reduction in size of the ink droplet is contradictory to obtaining a higher printing speed, it is important to increase the size of the ink droplet so as to realize a higher printing speed in addition to the reduction in size of the discharged ink droplet. In one example of the so-called side-shooter ink jet printhead having discharge ports on the side opposed to the electrothermal transducers (heaters) as described later, the discharge ports and the heaters are arranged corresponding to small ink droplets and large ink droplets, respectively. With the printhead thus constructed, by selectively driving the heaters for the small ink droplets and the heaters for the large ink droplets, the small ink droplets and the large ink droplets can be selectively discharged and higher quality of a printed image and a higher printing speed can be both realized. However, because the number of arranged heaters is increased, it is necessary to reduce the heater pitch and to array the heaters at a higher density.

Thus, in any of the cases of arraying the discharge ports at a higher density to reduce the size of the ink droplet for realizing higher quality of the printed image and the case of selectively using the small ink droplets and the large ink droplets to realize higher image quality and a higher printing speed, the heaters have to be arrayed at a higher density.

Such a requirement can be realized by employing heaters each having a small area to reduce the size of the ink droplet and by arraying the heaters at a higher density corresponding to the printing density. However, when the heaters are arranged in the form of a row at a higher density, rules for a line (wiring) width and a line-to-line distance are decided based on the restriction on the current density in lines associated with the heaters and the rate determined in a production process using photolithography. Accordingly, it is difficult to ensure a heater area for realizing the desired ink discharge amount.

SUMMARY OF THE INVENTION

The present invention is directed to a printhead substrate, a printhead, and a printing apparatus, which can ensure an area for arrangement of each of electrothermal transducers and can array the electrothermal transducers at a higher density while realizing higher quality of a printed image and a higher printing speed.

According to a first aspect of the present invention, a printhead substrate includes an electrothermal transducer array constituted by a plurality of electrothermal transducers which are arranged along an ink supply port adapted to supply ink, the transducers being configured to generate thermal energy to discharge the ink, and a circuit configured to perform time-division driving for a plurality of blocks obtained by dividing the plurality of electrothermal transducers in the electrothermal transducer array. In units of a group constituted by plural electrothermal transducers belonging to each of the different blocks, one-end sides of the plural electrothermal transducer in the group are connected to a common wiring which is arranged to extend along the ink supply port and is separated from common wirings for other groups. The other-end sides of the plural electrothermal transducer in the group are connected respectively to an individual wiring. Plural lines connected to the common wiring are each arranged in an adjacent or sandwiched relation to the electrothermal transducers in the group.

According to a second aspect of the present invention, a printhead includes the printhead substrate and a discharge port forming member forming ink discharge ports corresponding to the electrothermal transducers.

According to a third aspect of the present invention, in a printing apparatus configured to print an image on a printing medium by using the printhead and by discharging ink through the ink discharge ports, the printing apparatus includes a mechanism arranged to relatively move the printhead and the printing medium.

According to the present invention, the plural electrothermal transducers belonging to each of the blocks having different driving timings are constituted as one group and are connected to the common wiring in units of one group. Plural lines are connected to the common wiring such that the plural lines are extended to return with respect to the electrothermal transducers and are each arranged to extend in an adjacent or sandwiched relation to the electrothermal transducers. With such an arrangement, the width of each of the plural lines can be reduced. As a result, higher quality of a printed image and a higher printing speed can be realized by arraying the heaters at a higher density while ensuring a sufficient area for arrangement of each of the electrothermal transducers. Further, the electrothermal transducers can be arrayed at the higher density by employing the known production process. In addition, downsizing of both the printhead substrate and the printhead can be resulted.

Further features of the present invention will become apparent from the following description of exemplary embodiments with reference to the attached drawings.

DESCRIPTION OF THE EMBODIMENTS

Exemplary embodiments of the present invention will be described below with reference to the drawings.

First Exemplary Embodiment

Figure 1:
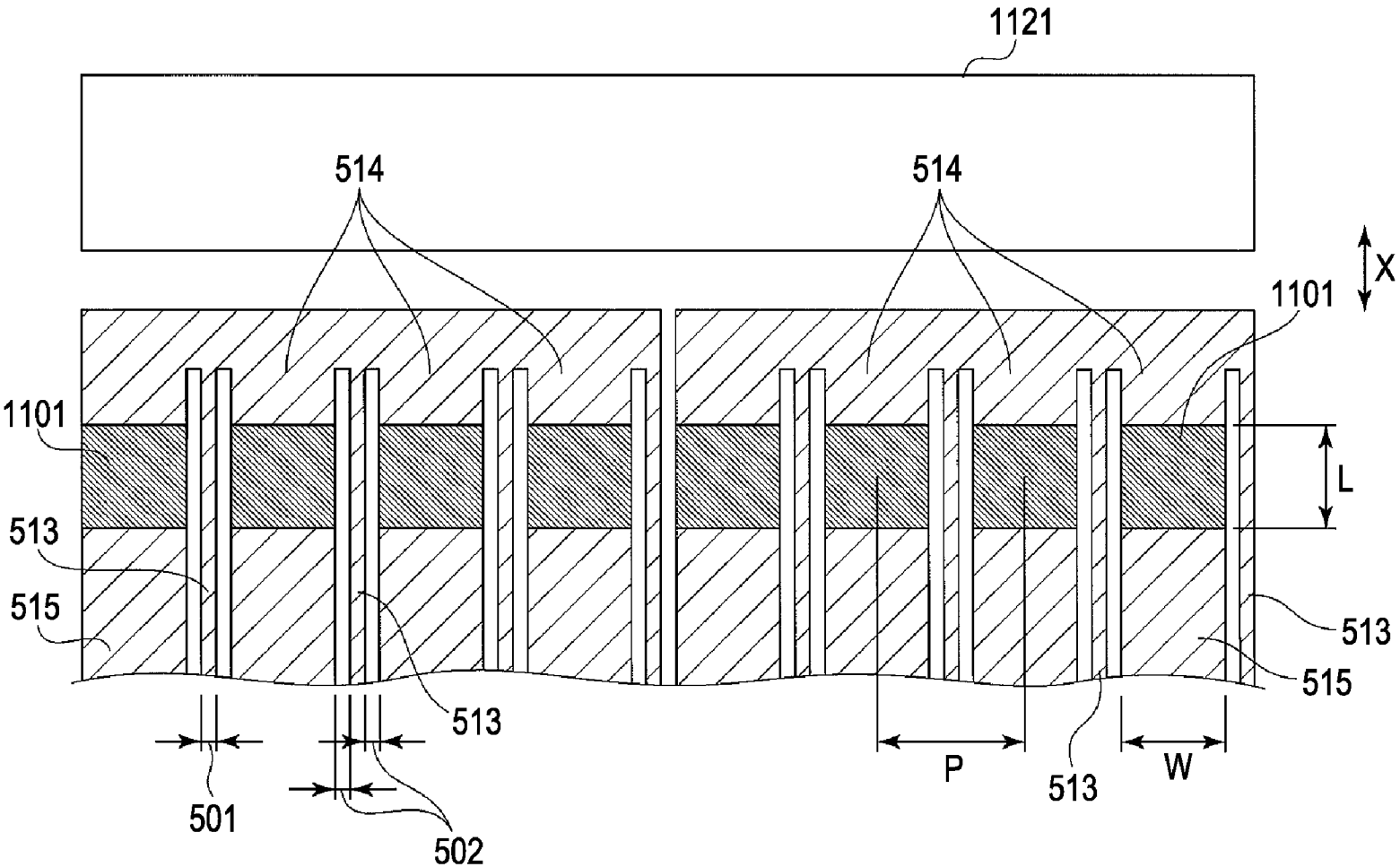
FIG. 1 is a schematic plan view of a heater portion of a printhead substrate according to a first exemplary embodiment of the present invention.
Figure 2:
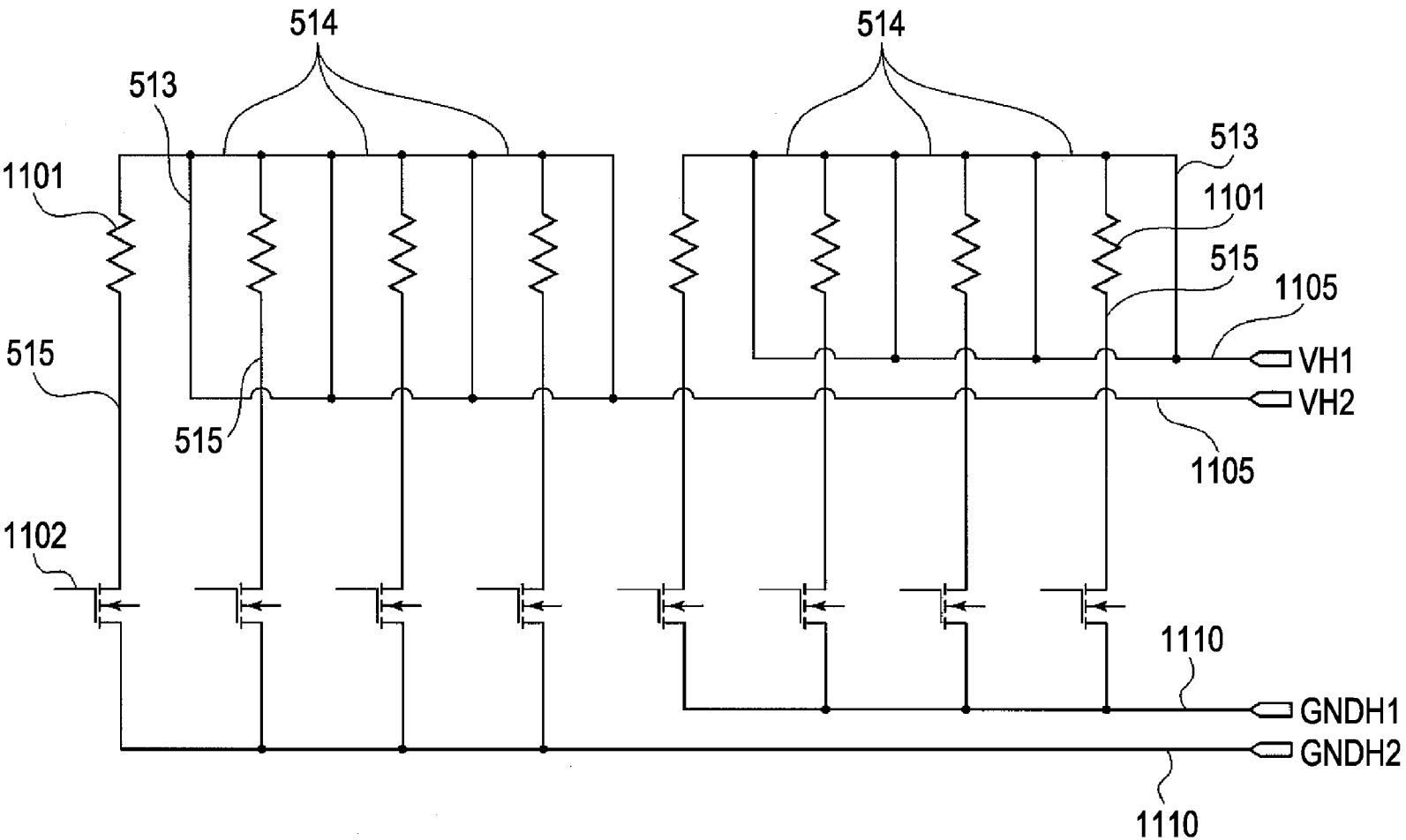
FIG. 2 is an electric circuit diagram corresponding to heaters and lines (wirings) in FIG. 1.

FIGS. 1 and 2 are explanatory views of a heater portion of a printhead substrate according to a first exemplary embodiment of the present invention.

Prior to describing the construction of the heater portion of the printhead substrate, which is the feature of the present invention, a description is first given of exemplary constructions of a driving circuit formed in the printhead substrate, signals used to drive the driving circuit, a printhead, and a printing apparatus using the printhead.

Exemplary Construction of Driving Circuit

The printhead substrate includes, as described in detail later, electrothermal transducers (also called "heaters" hereinafter) and a driving circuit arranged to drive the heaters. The heaters and the driving circuit are formed on the same printhead substrate by employing the semiconductor process technique.

Figure 8:
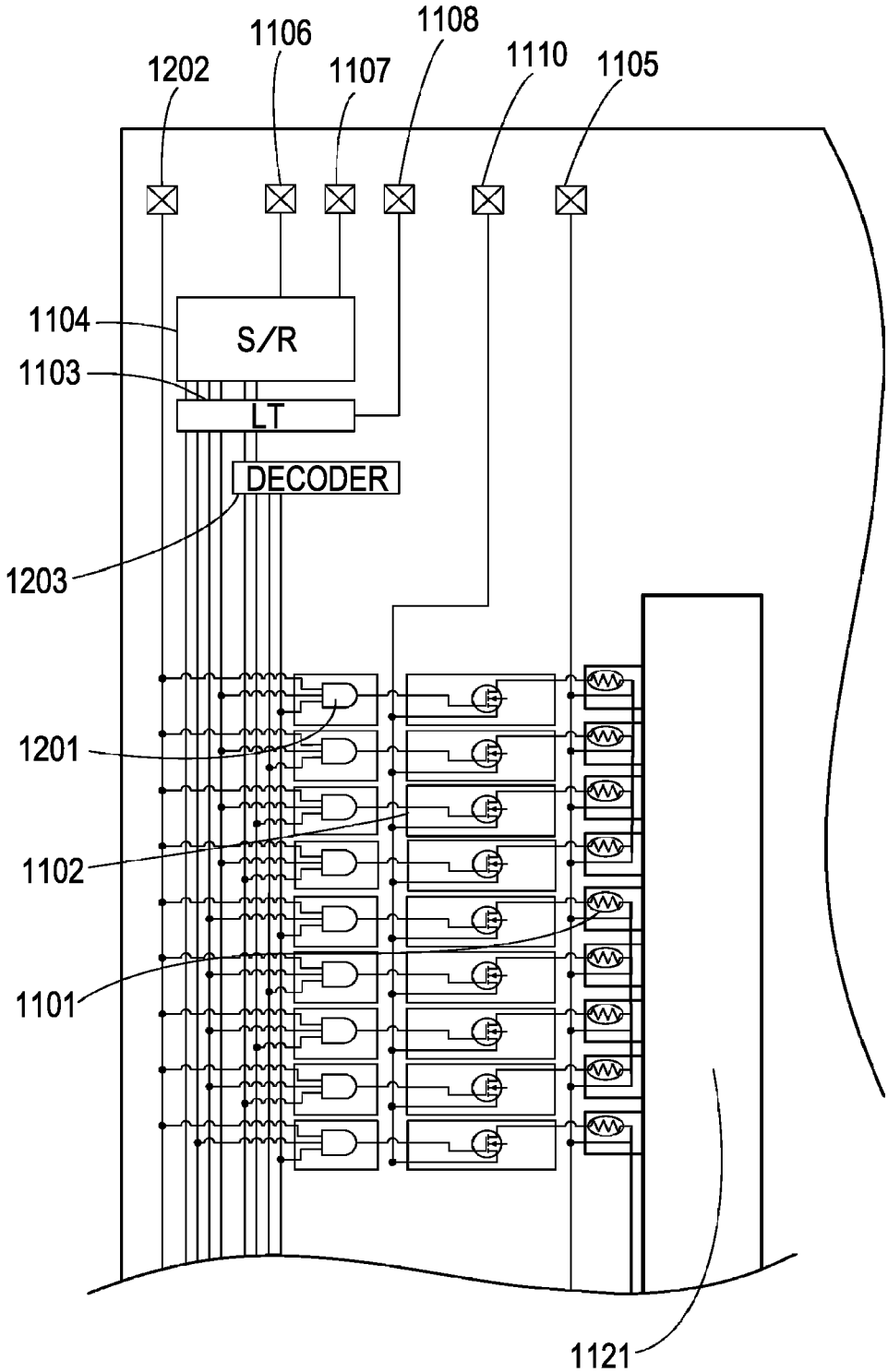
FIG. 8 is an explanatory circuit diagram illustrating one example of a heater driving circuit which can be formed on the printhead substrate according to the present invention.

FIG. 8 is an explanatory circuit diagram illustrating one example of the driving circuit formed on the printhead substrate.

In FIG. 8, the driving circuit includes heaters 1101 which generate thermal energy, and transistors 1102 which perform switching to selectively supply desired currents for driving of the heaters 1101. An AND gate 1201 serves as a heater selection circuit outputting a heater driving signal which turns on/off each of the transistors 1102. When the transistor 1102 is turned on, a current is allowed to flow from a power supply wiring (line) 1105 to the corresponding heater 1101 and further to a ground wiring (GND line) 1110 through the transistor 1102, whereby the heater 1101 is driven.

A shift register (S/R) 1104 temporarily stores data including image data (DATA). Based on the stored data, whether a current is supplied to each heater 1101, i.e., whether the heater 1101 is turned on/off to discharge ink from a nozzle of the later-described printhead, is determined. A transfer clock input terminal 1107 receives a transfer clock (CLK) applied to the shift register 1104. A data input terminal 1106 serially receives the image data (DATA) used to turn on/off the heater 1101 and block control data decoded by a decoder 1203. A latch circuit 1103 holds the image data and the block control data, and a latch signal input terminal 1108 inputs a latch timing signal (LT) to the latch circuit 1103. The power supply wiring (line) 1105 applies a predetermined voltage to the heater 1101 for supply of the current. The ground wiring (GND line) 1110 grounds the heater 1101 through the transistor 1102. A heat-enable signal input terminal 1202 receives a heat-enable signal which specifies the timing of driving the heater 1101.

In the first exemplary embodiment, of the data stored in the shift register 1104, one bit of the image data is input in common to the AND gates 1201 corresponding to four adjacent heaters. In other words, circuit elements are divided into groups in units of those four adjacent heaters, transistors, and corresponding four AND gates.

The block selection signal output from the decoder 1203 enables the so-called time-division driving to be performed such that the timings of driving the heaters are shifted from each other on the time basis. Further, plural ones of the heaters in one group cannot be driven at the same time. In addition, as described in detail later, lines on the VH (high voltage) side of the heaters are common in one group.

A description is next given of a signal for turning on the heater driving signal from the AND gate 1201 (i.e., a signal enabling the heater to be driven) and of a turning-on condition. The present invention employs the time-division driving method to drive the heaters. The term "time-division driving method" means a method of setting a time-basis zone (block) and driving the heaters successively per block, instead of driving all the heaters in a heater row (array) at the same time, thereby reducing the number of heaters driven at the same time.

First, the data is input to and stored in the shift register 1104, which temporarily stores the data, through the data input terminal 1106 in sync with the transfer clock (CLK) 1107. The data stored in the shift register 1104 is taken out to the latch circuit 1103 at the timing of the latch signal (LT) 1108.

One part of the data taken out of the shift register 1104 provides an image data signal, and the other part provides the block selection signal generated through the decoder 1203. The AND gate 1201 is turned on to drive the heater on condition that the image data signal, the time-division signal, and the heat-enable signal are all produced at the same time.

Example of Driving Signal

Figure 9:
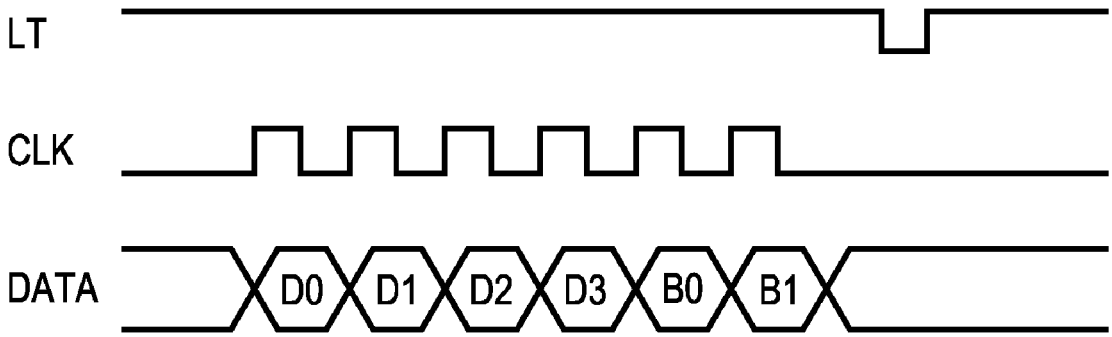
FIG. 9 is a timing chart illustrating the operation of the heater driving circuit in FIG. 8.

FIG. 9 is a timing chart of various signals used to drive the printhead driving circuit in FIG. 8. The operation of the printhead driving circuit in FIG. 8 will be described with reference to FIG. 9.

The transfer clocks (CLK) corresponding to the number of bits of the data stored in the shift register 1104 are input to the transfer clock input terminal 1107. In this example, it is assumed that the data transfer to the shift register 1104 is performed in sync with the timing of a rise of the transfer clock (CLK). The image data and the block control data both used to turn on/off each heater 1101 are input through the data input terminal 1106. Because 6-bit data is transferred herein, pulses of the transfer clocks (CLK) for 6 bits are input and temporarily stored in the shift register 1104. Further, the latch signal (LT) is applied to the latch signal input terminal 1108 to hold the data (DATA) in the latch circuit 1103.

Figure 12:
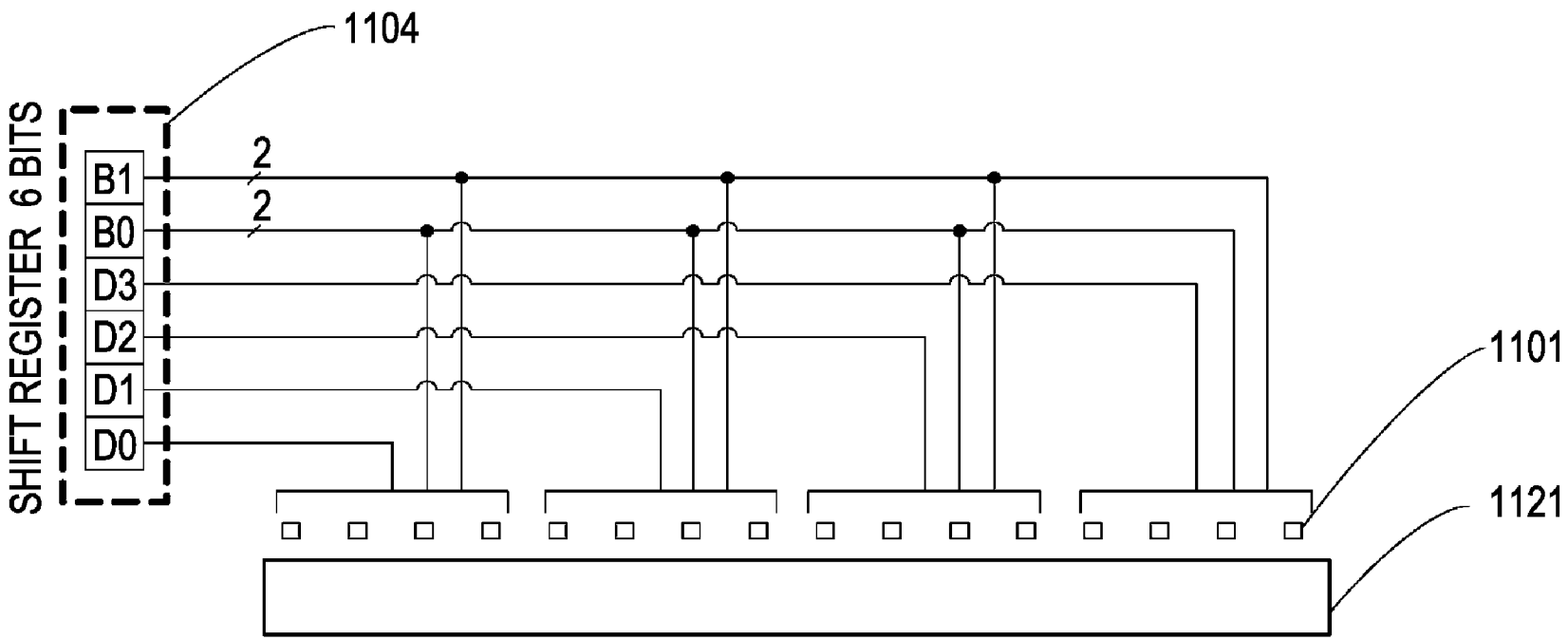
FIG. 12 is a diagram illustrating a time-division driving method.

With reference to FIG. 12, a description is next given of only a portion of the circuit in FIG. 8, which is related to the time-division driving method used in the first exemplary embodiment of the present invention.

When the time-division driving method is performed with time division at $N(2^n)$, the heater array is divided into groups (blocks) each of which includes a number $N(2^n)$ of heaters and which exist in number m. The data input to the shift register is provided by two kinds of data, i.e., the block control data specifying which one of the time-division blocks is selected, and the image data corresponding to the relevant time-division block.

Because the block control data is decoded by the decoder 1202 (not shown in FIG. 12), the input block control data has n bits in the case of the time division at $N(2^n)$. Therefore, the data input to the shift register is provided by the block control data of n bits and the image data of m bits. This means that the shift register and the latch circuit each having (n+m) bits are required. In the first exemplary embodiment, the shift register 1104 receives two bits of B1 and B2 as the block control data which is decoded to drive the heaters with the time division into four blocks. More specifically, in the first exemplary embodiment, four adjacent heaters constitute one group and each heater in one group corresponds to each of the different time-division blocks. Hence, plural heaters in one group are not driven at the same time. In the present invention, as described later, lines (wirings) are connected together in units of one group including the plural heaters which are not driven at the same time.

When the time-division driving is performed, all the heaters (four time-division blocks×4 bits=16) are driven by inputting the data of (n+m) bits (6 bits in the first exemplary embodiment) successively $N(2^n)$ times (four times in the first exemplary embodiment), thus inputting the heater driving signals in a one-to-one relation to all the heaters. The switching transistor 1102 serves as a switch which allows the current to selectively flow into the heater in the above-described circuit arrangement.

The switching transistor 1102 is turned on for a time corresponding to the heat-enable signal. For the time during which the switching transistor 1102 is turned on, the current from the power supply line 1105 flows into the GND line 1110 through the heater 1101 and the switching transistor 1102. With the supply of the current, the heater 1101 generates heat necessary for discharging ink and the ink is discharged from the nozzle of the printhead in accordance with the image data.

Exemplary Construction of Printhead

Figure 10:
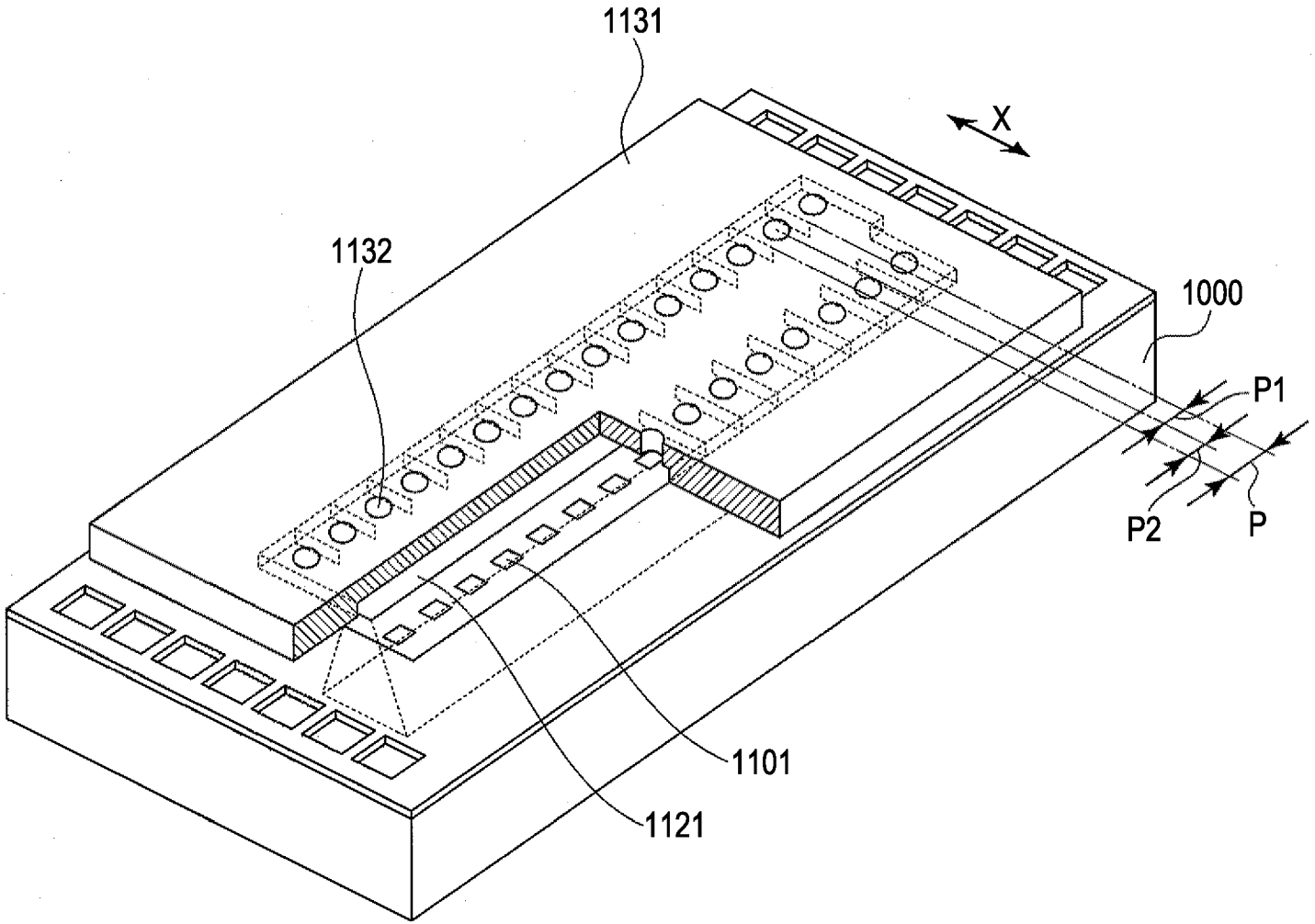
FIG. 10 is a perspective view, partly cut away, illustrating one example of a printhead using the printhead substrate according to the present invention.

FIG. 10 is an explanatory view illustrating the exemplary construction of the printhead using the above-described printhead substrate. More specifically, FIG. 10 is a perspective view, partly cut away, illustrating the nozzle portion of the printhead. The printhead in the first exemplary embodiment is the so-called side-shooter ink jet printhead. In the side-shooter ink jet printhead, ink supplied to a position above the heater 1101 is bubbled upon heating of the heater 1101, and bubble generating energy generated at that occasion is utilized to discharge the ink through a discharge port (nozzle) 1132 formed at a position corresponding to the heater 1101.

The printhead substrate 1000 can be formed of, e.g., a Si wafer (substrate) having a thickness of 0.5-1 mm. On the surface of the printhead substrate 1000, the heaters 1101 and the heater driving circuit, described above with reference to FIG. 8, can be formed by employing the semiconductor process technique. The discharge ports 1132 through which is discharged the ink can be formed by photolithography using a discharge port forming member (resin material) 1131, along with ink passage walls positioned corresponding to the heaters 1101 on the printhead substrate 1000.

An ink supply port 1121 through which is supplied the ink can be formed by anisotropic etching utilizing the crystal orientation of the Si wafer of the printhead substrate 1000. More specifically, the ink supply port 1121 is formed as a through hole shaped into an elongate groove and having slopes which are inclined such that the through hole is gradually narrowed from the rear surface toward the front surface of the printhead substrate 1000.

In the printhead substrate 1000 according to the first exemplary embodiment, two heater arrays are formed one on each of both sides of the ink supply port 1121, and the discharge ports 1132 are formed in an opposed relation to the heaters 1101 in the two heater arrays. Stated another way, the heaters (electrothermal transducers) 1101 are arrayed along the lengthwise direction of the ink supply port 1121. The discharge ports 1132 in each of two discharge port arrays are formed at the same pitch P, and the discharge ports 1132 in one discharge port array are shifted by pitches P1 and P2 from respective adjacent discharge ports 1132 in the other discharge port array in the direction in which the discharge ports 1132 are arrayed. The pitches P, P1 and P2 can be optionally set, for example, such that the pitches P1 and P2 are each ½ of the pitch P. The heaters 1101 are arranged corresponding to those pitches of the discharge ports 1132. Note that the discharge port array can be formed in number other than two, i.e., one or three or more.

A channel member for introducing the ink is connected to the ink supply port 1121 and a container containing the ink (i.e., an ink tank) is combined with the channel member, whereby a printhead cartridge including the printhead and the ink tank can be constructed. A color image can be printed by constructing a printhead cartridge in combination of containers (ink tanks) containing respective inks of plural colors and the printhead substrates corresponding to the respective inks of plural colors.

Exemplary Construction of Printing Apparatus

Figure 11:
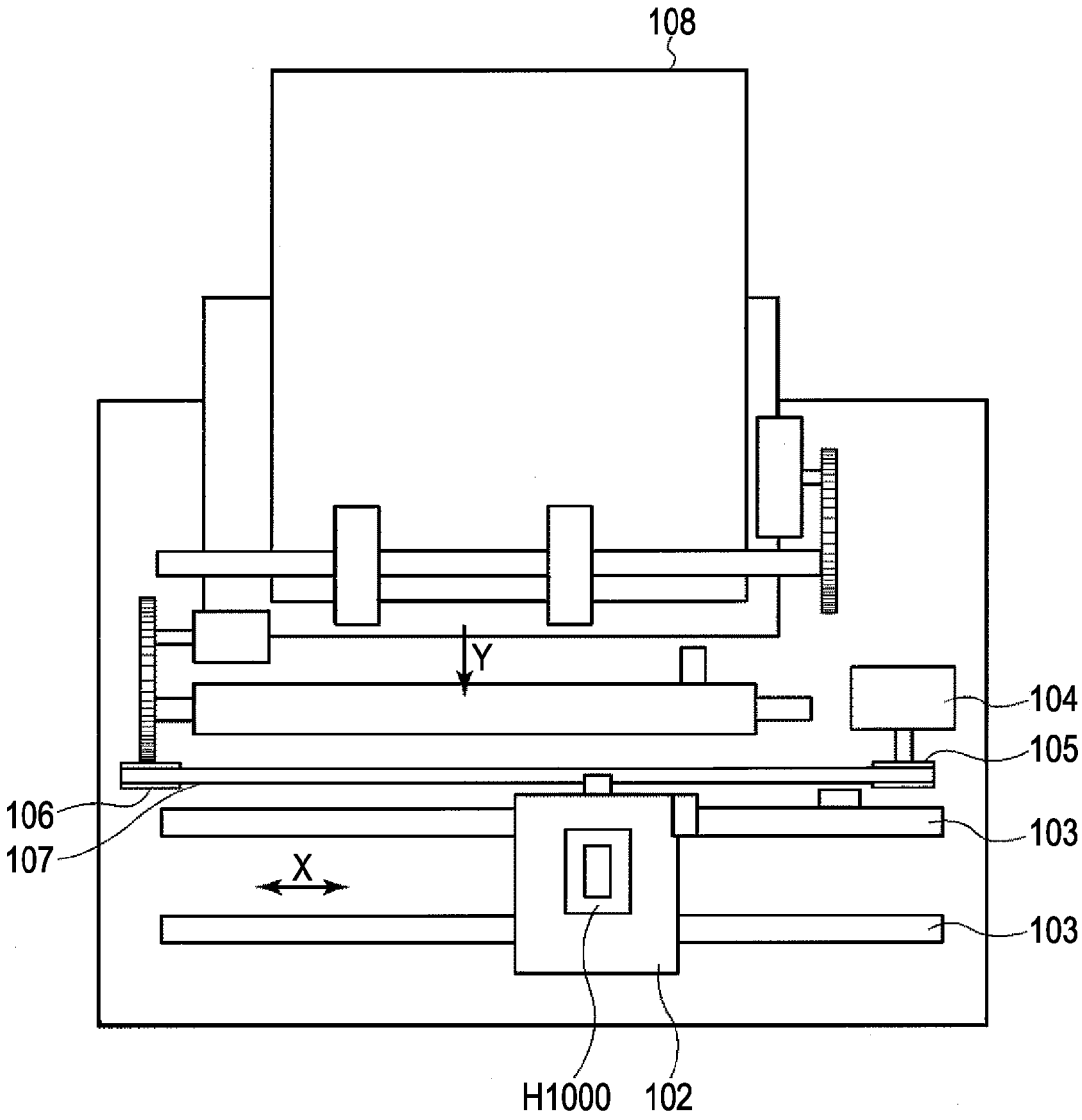
FIG. 11 is an explanatory view illustrating one example of a printing apparatus using the printhead in FIG. 10.

FIG. 11 is an explanatory view illustrating the exemplary construction of a printing apparatus to which is mountable the printhead using the above-described printhead substrate.

In the printing apparatus according to the first exemplary embodiment, a printhead cartridge H1000 is mounted to a carriage 102 in a replaceable manner. The carriage 102 has an electric connector which can be electrically connected to an external signal input terminal of the printhead cartridge H1000. The printhead driving signal, etc. are transmitted from the electric connector of the carriage 102 through the external signal input terminal of the printhead cartridge H1000.

The printing apparatus according to the first exemplary embodiment is the so-called serial scanning printing apparatus. The carriage 102 is supported so as to be able to reciprocally move in the direction of main scanning, indicated by an arrow X, along a guide shaft 103 mounted to a main body of the printing apparatus. The carriage 102 is coupled to a timing belt 107 looped between a motor pulley 105 and a driven pulley 106. When the motor pulley 105 is driven to rotate by a main scanning motor 104, the carriage 102 is moved in the direction of main scanning under control. A printing medium 108 is supported on a platen (not shown) with its rear surface rested on the platen such that a flat print surface is formed in a printing region. In the illustrated example, the discharge port array is arranged to extend in a direction perpendicular to the direction of main scanning.

When an image is printed on the printing medium 108, print scanning by the printhead cartridge H1000 and an operation of conveying the printing medium 108 are repeated. More specifically, in the print scanning, the printhead cartridge H1000 is moved in the direction of main scanning together with the carriage 102 while the ink is discharged through the discharge ports. In the conveying operation, the printing medium 108 is conveyed by a predetermined distance in the direction of sub-scanning.

Construction of Heater Portion of Printhead Substrate

A description is next given of the construction of the heater portion of the printhead substrate which is the feature of the present invention.

FIG. 1 is a schematic enlarged plan view of a portion including the heaters 1101 of the printhead substrate 1000 according to the first exemplary embodiment of the present invention, and FIG. 2 is an explanatory diagram of an electric circuit connected to the heaters 1101 in FIG. 1. The printhead substrate 1000 is formed by using the multilayer wiring technique. On the printhead substrate 1000, wirings (lines made of aluminum, copper, gold, or an alloy containing aluminum, copper or gold) interconnecting the components have a multilayered structure in which a wiring layer is sandwiched between insulating layers. The lines of upper- and lower-side wiring layers are connected to each other via through holes (openings of the insulating layer) formed at desired positions on the printhead substrate 1000, thereby forming a circuit.

The heaters 1101 are each formed of a resistance (made of, e.g., a tantalum alloy) and, as indicated by rough hatching in FIG. 1, lines 513 and 514, and individual wiring 515 are formed at opposite ends of the resistance to supply heating energy. The individual wiring (first lines) 515 are each formed in an area below the heater 1101 as viewed on the drawing sheet of FIG. 1, (i.e., in an area on one side of the heater 1101 in a direction crossing the direction in which the heaters 1101 are arrayed) to extend downward from there as viewed on the drawing sheet of FIG. 1, for connection to the switching transistor 1102. The lines (second lines) 513 are each formed to return from an area above the heater 1101 as viewed on the drawing sheet of FIG. 1, (i.e., in an area on the other side of the heater 1101 in the direction crossing the direction in which the heaters 1101 are arrayed), to extend downward from there as viewed on the drawing sheet of FIG. 1, and to further extend in an adjacent or sandwiched relation to the heaters 1101 in the same group (block). The line 513 is also called a return wiring hereinafter. The lines (third lines) 514 are each formed between the heaters 1101 and the ink supply port 1121 to interconnect the plural lines 513 (four in the first exemplary embodiment) in units of group (i.e., in the same group). The line 514 is also called an interconnecting wiring hereinafter. Thus, the plural lines (return wirings) 513 each arranged in an adjacent or sandwiched relation to the heaters 1101 are connected to one interconnecting wiring 514.

In the printhead substrate 1000 of the multilayered structure, the resistances constituting the heaters 1101 are formed in the same one layer by using the multilayer wiring technique, and the lines 513, 514 and 515 are also formed in the same one layer as the resistances. Generally, the resistances and the lines 513, 514 and 515 are covered with the same one insulating layer (protective film layer) formed thereon. On that occasion, an optimum film thickness of the insulating layer (protective film layer) is determined in consideration of reliability of an insulating film and the efficiency of utilization of the heat generated by the heaters 1101.

The film thickness of the underlying wiring layer (i.e., the layer in which the lines 513, 514 and 515 are formed) is also determined in view of satisfactory coverage depending on the optimum film thickness of the insulating layer. In the general production method using photolithography, the film thickness of a wiring layer is limited to be not larger than the film thickness of an insulating layer. In the first exemplary embodiment, the film thickness of the insulating layer is about 3000 A (angstroms) and the film thickness of the wiring layer is about 2000 A. Further, in the first exemplary embodiment, the shape (W×L) of each heater 1101 is set to 15×15 μm to obtain an ink discharge amount Vd, and the heaters 1101 are arrayed at 1200 dpi (dots/inch) to realize high-quality and high-speed printing. Note that 1200 dpi corresponds to 21 μm in terms of the array pitch P of the heaters 1101.

The lines 513, 514 and 515 are formed in conformity with arrangement rules depending on production conditions (generally called "wiring rules"). The arrangement rules are based on the production method using photolithography. The first exemplary embodiment employs the arrangement rules of setting a minimum line width of the wiring to 2 μm and a minimum space width to 2 μm. Therefore, the return wiring 513 has a line width 501 of 2 μm and a space width 502 of 2 μm. A ratio of a heater width W to the pitch P of the heaters 1101 (i.e., W/P) is 71.4%. Such a ratio is preferably not less than 70% from the viewpoint of realizing a high-density array of the heaters.

The ink supply port 1121 is formed, as described above, to supply the ink toward the discharge ports 1132 (see FIG. 10) from the rear side of the printhead substrate 1000. The heaters 1101 are arranged at a high density so as to form a heater array along the ink supply port 1121. In the first exemplary embodiment, four adjacent heaters 1101 constitute one group and the power supply lines 1105 and 1110 are formed in units of the group. As shown in FIG. 2, the power supply lines 1105 and 1110 connected respectively to a connection terminal VH1 and a ground terminal GNDH1 are formed for the heater group constituted by four heaters 1101 located on the right side as viewed on the drawing sheet of FIG. 2. Similarly, the power supply lines 1105 and 1110 connected respectively to a connection terminal VH2 and a ground terminal GNDH2 are formed for the heater group constituted by four heaters 1101 located on the left side as viewed on the drawing sheet of FIG. 2. While the power supply line and the ground line are each formed as a single line in FIG. 8 described above, FIG. 2 illustrates the case where the power supply line and the ground line are formed for each heater group.

Thus, the four heaters 1101 in one heater group are connected in parallel to the common power supply line 1105 and the common ground line 1110. As described above, the heaters 1101 in one heater group belong to the time-division blocks in which the heaters are driven at different timings, and the transistors 1102 corresponding to the four heaters 1101 drive those four heaters 1101 successively with a time shift therebetween without driving them at the same time. Such a driving method is called the time-division driving method. The first exemplary embodiment employs a 4-division driving method.

FIGS. 1 and 2 show only eight heaters 1101 corresponding to eight discharge ports (nozzles) 1132. When a nozzle array including thirty-two discharge ports 1132 is formed, for example, thirty-two heaters 1101 are arrayed and the 4-division driving is performed by dividing the thirty-two heaters into 8 groups in units of four heaters. Correspondingly, the power supply lines 1105 and 1110 are each formed in number eight.

In the first exemplary embodiment, the four return wirings 513 in each heater group are interconnected at a position between the heater array and the ink supply port 1121 by the interconnecting wiring (common wiring) 514 which is extended substantially parallel to the lengthwise direction of the ink supply port 1121. The interconnection of the return wirings 513 enables a reduction of the line width 501 of each of the return wirings 513 positioned adjacent to the heaters 1101. In other words, the line width 501 of one return wiring 513 can be reduced in comparison with the case where the return wirings 513 are not interconnected by the interconnecting wiring 514. As a result, the width W of each heater 1101 can be increased while keeping the same pitch P.

In the first exemplary embodiment, the number of the heaters 1101 is the same as that of the return wirings 513, and the number of the return wirings 513 in each heater group is four. The return wirings 513 are each arranged in an adjacent or sandwiched relation to the heaters 1101 as shown in FIG. 1, and the density of a current flowing through one return wiring 513 is set to be held from exceeding a predetermined value. Further, the above-described arrangement of the return wirings 513 is effective in not only avoiding an uneven distribution of the current density among the return wirings 513 in each heater group, but also preventing the occurrence of a line resistance difference and a current difference depending on positions of the heaters 1101.

Particularly, in the first exemplary embodiment, the heaters 1101 not driven at the same time based on the time-division driving method constitute one group, the interconnecting wiring 514 is formed corresponding to one group, and the plural lines (return wirings) 513 each arranged in an adjacent or sandwiched relation to the heaters 1101 are connected to the interconnecting wiring 514. Therefore, the width of each of the return wirings in one group can be further reduced.

As a result, the heaters 1101 can be arrayed at a higher density, and higher-quality and higher-speed printing of an image can be realized with stable discharge of the ink.

Comparative Examples

Figure 5:
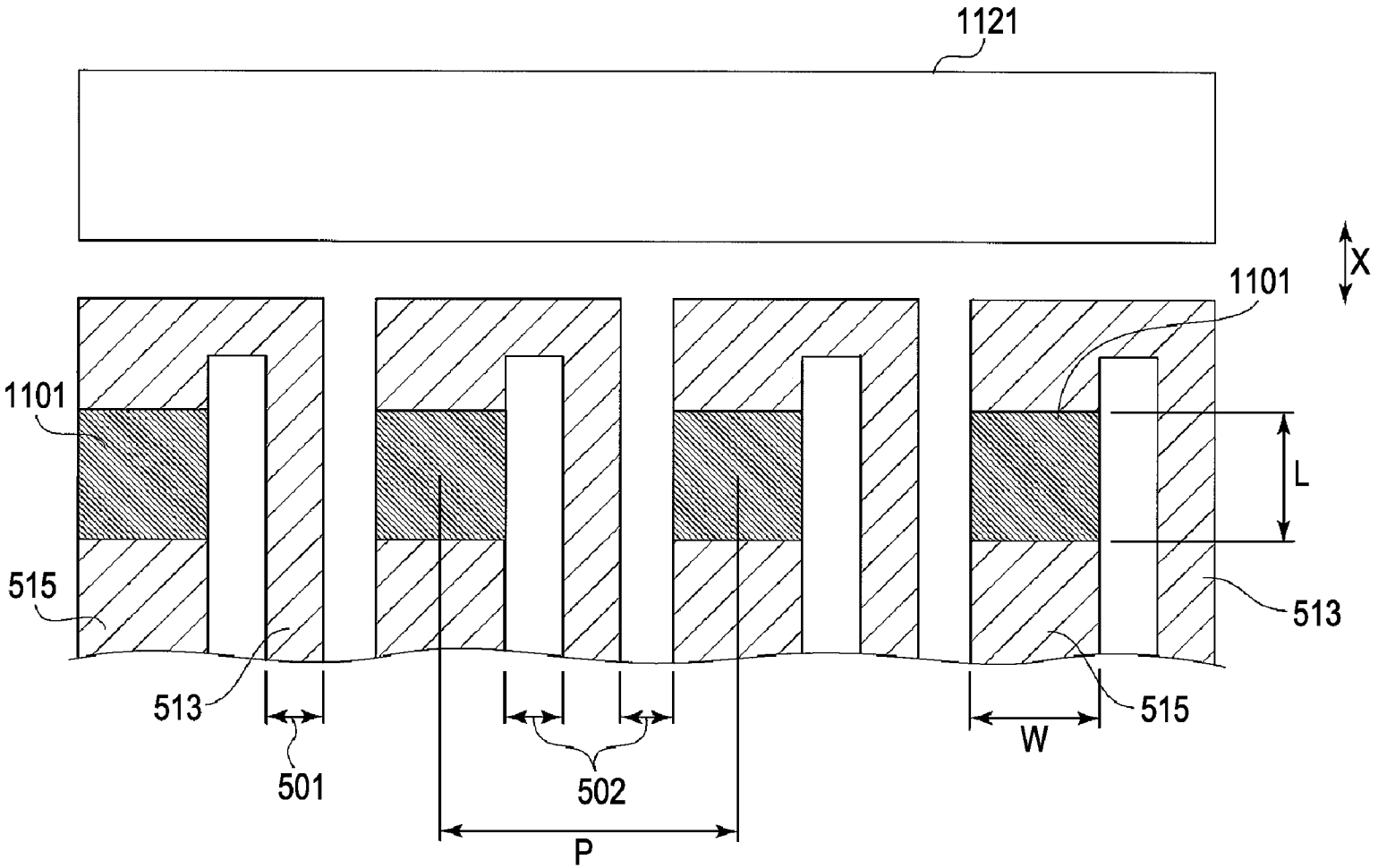
FIG. 5 is a schematic plan view of a heater portion of a printhead substrate as one Comparative Example.
Figure 6:
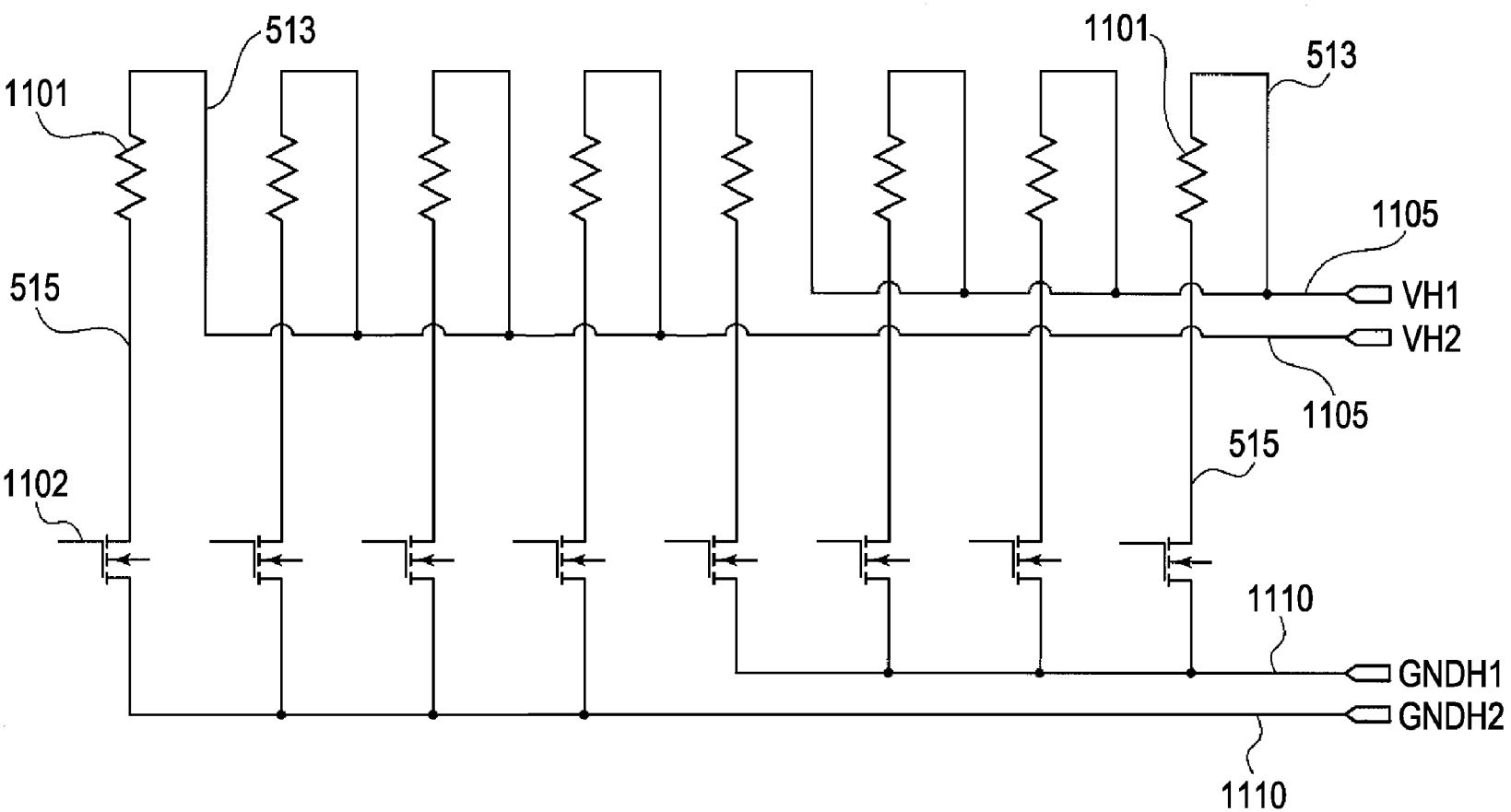
FIG. 6 is an electric circuit diagram corresponding to heaters and lines in FIG. 5.
Figure 7:
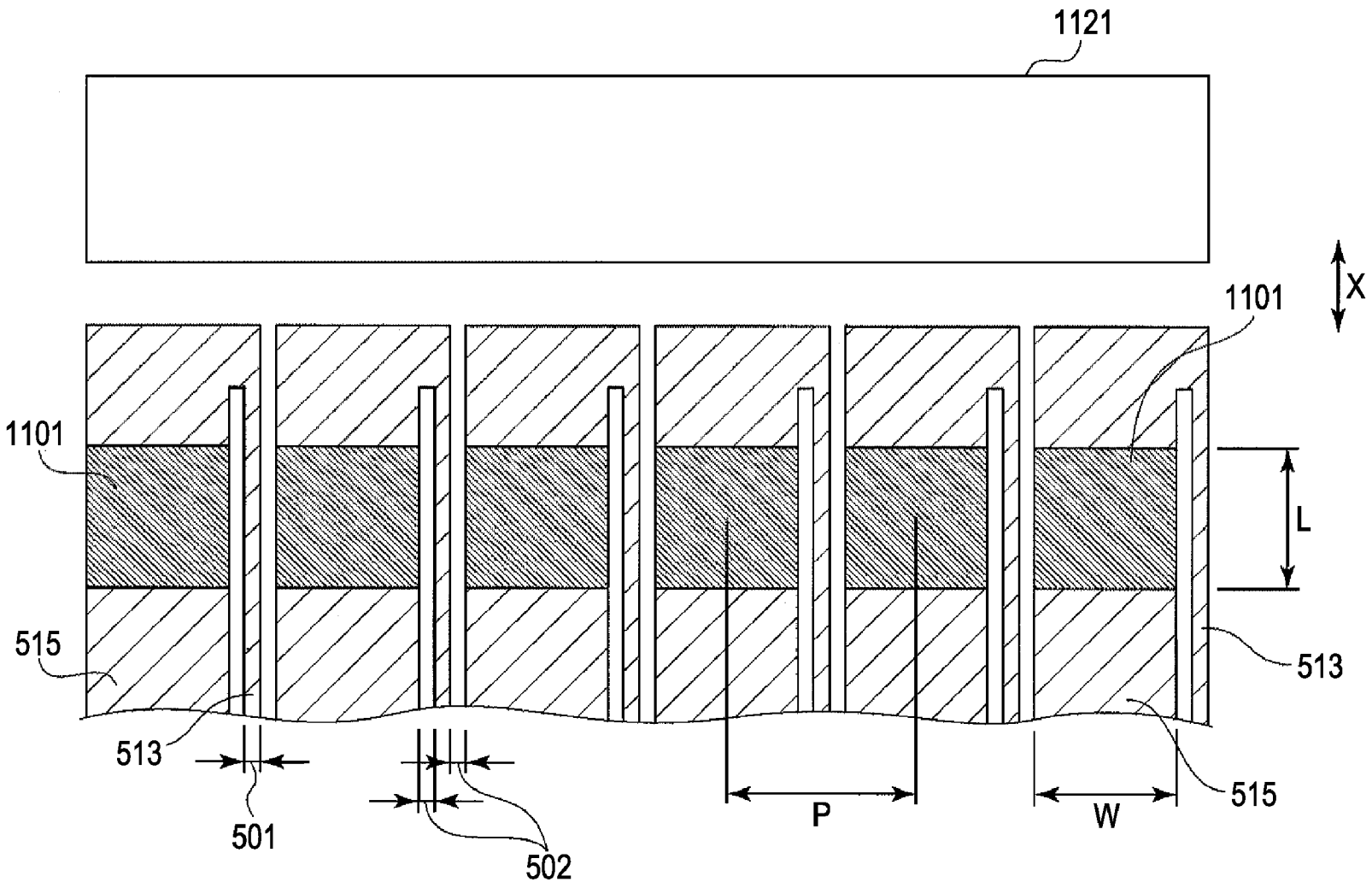
FIG. 7 is a schematic plan view of a heater portion of a printhead substrate as another Comparative Example.

FIGS. 5-7 illustrate Comparative Examples for the purpose of comparing with the printhead substrate 1000 according to the present invention. The interconnecting wiring and the plural return wirings 513 connected to the interconnecting wiring are not formed in printhead substrates of Comparative Examples.

In FIGS. 5 and 6, printing elements each including a discharge port (see 1132 in FIG. 10), a separated channel, and a heater 1101 are arranged at an array density of 600 dpi in the form of a row along an ink supply port 1121, and the amount of ink discharged through the discharge port is set to Vd. As in the above-described first exemplary embodiment, the heaters 1101 positioned in lower portions of the printing elements are arranged in the form of a row similarly to the printing elements. Roughly hatched areas in FIG. 5 represent lines 513 and 515 connected to each heater 1101.

In order to arrange the printing elements each having the ink discharge amount of Vd in the form of a row at the array density of 600 dpi, the heaters 1101 are also required to be arranged in the form of a row at the array density of 600 dpi. For realizing such an array density, the pitch P of the heaters 1101 has to be set to 42 μm. In this Comparative Example, electrodes for the heaters 1101 are formed by a method of arranging the electrodes in a perpendicular relation to the direction of the heater row as in the above-described first exemplary embodiment of the present invention, i.e., by a method of arranging the heater electrodes (connecting portions to the lines) to position in the vertical direction, as viewed on the drawing sheet of FIG. 5, perpendicularly to the direction in which the heaters 1101 are arrayed. When individual return wirings 513 each have a line width 501 of 8 μm and a space width 502 of 8 μm, the width W of each heater 1101 is 18 μm at maximum in conformity with the wiring rules. Thus, the heaters 1101 each having a square shape of 18×18 μm, for example, are arranged to ensure the ink discharge amount Vd. The ratio of the heater width W to the pitch P (i.e., W/P), is 42.9%.

FIG. 6 is an electric circuit diagram representing the arrangement of the heaters 1101 and the lines 513, 514 and 515 in FIG. 5.

It is here assumed that the heaters 1101 (each having the size of, e.g., 18×18 μm) with the same ink discharge amount Vd are arranged at a higher array density of 900 dpi than 600 dpi shown in FIG. 6. In such a case, the pitch P of the heaters 1101 is required to be set to 28 μm. When the heaters 1101 are formed by the method arranging the electrodes in a perpendicular relation to the direction of the heater row such that the line width 501 of the return wiring 513 is specified to 8 μm and the space width 502 is specified to 8 μm in conformity with the wiring rules, the width W of the heater 1101 is 4 μm at maximum. It is hence understood that the heaters 1101 cannot be arranged at the pitch P of 28 μm.

An obstacle to such a higher-density array of the heaters 1101 is the return wiring 513. The arrangement of the heaters 1101 (each having the size of, e.g., 18×18 μm) with the ink discharge amount Vd at the pitch P of 28 μm can be realized if the line width 501 of the return wiring 513 is specified to 2 μm and the space width 502 is specified to 2 μm in conformity with the wiring rules. FIG. 7 is an explanatory view illustrating the case where the return wirings 513 are formed in conformity with those wiring rules. In the case of FIG. 7, however, the cross-sectional area of each return wiring 513 is reduced to ¼ of that in the case of FIG. 5 and the current density is quadrupled if the film thickness of the return wiring 513 is not changed.

The same cross-sectional area of the return wiring 513 can be maintained by increasing the film thickness of the return wiring 513 four times so as to compensate for the reduction of the line width. However, because the return wiring 513 is a line connected to the heater electrode, the film thickness of only the return wiring 513 has to be increased without increasing the film thickness of the insulating layer (protective film layer) formed on the return wiring 513. That requirement straightly deteriorates the line coverage, thus resulting in a risk of reducing reliability of the heater 1101. Also, because increasing the film thickness of the insulating layer (protective film layer) to ensure the satisfactory line coverage means a larger film thickness of the insulating layer (protective film layer) formed on the heater 1101, there arises a risk of greatly reducing the efficiency of ink bubbling and impeding stability of the ink discharge. Further, when trying to realize a higher array density of the heaters 1101, as another example, by a method of using a layer different from the layer in which the heaters 1101 are formed, and forming the heaters 1101 and electrode lines in a three-dimensionally overlapped relation, it is apparent that the production process is more complicated.

Thus, with Comparative Examples in which the interconnecting wiring 514 used in the above-described first exemplary embodiment of the present invention is not used, a difficulty arises in arraying the heaters 1101 at a higher density.

Second Exemplary Embodiment

Figure 3:
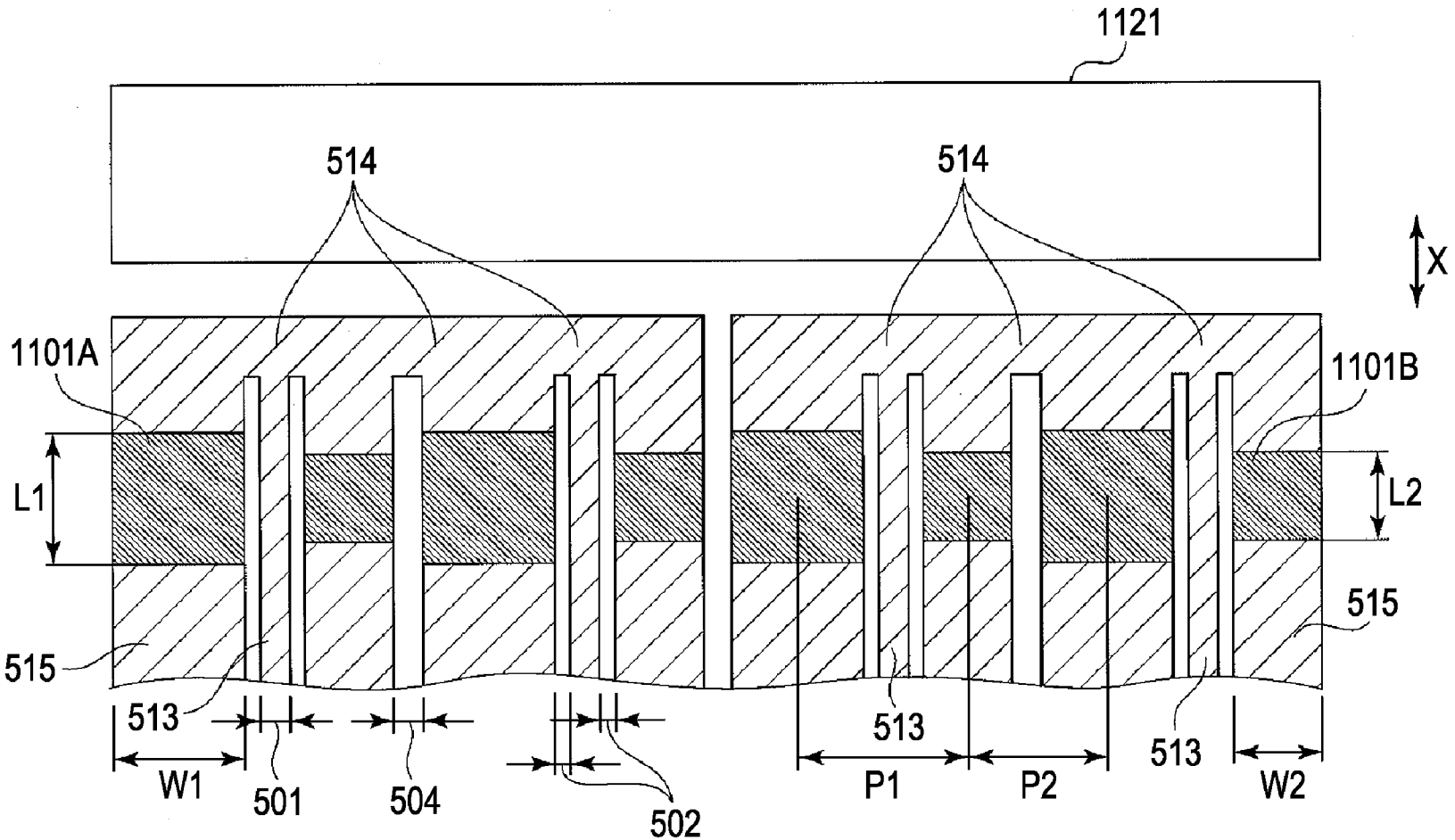
FIG. 3 is a schematic plan view of a heater portion of a printhead substrate according to a second exemplary embodiment of the present invention.
Figure 4:
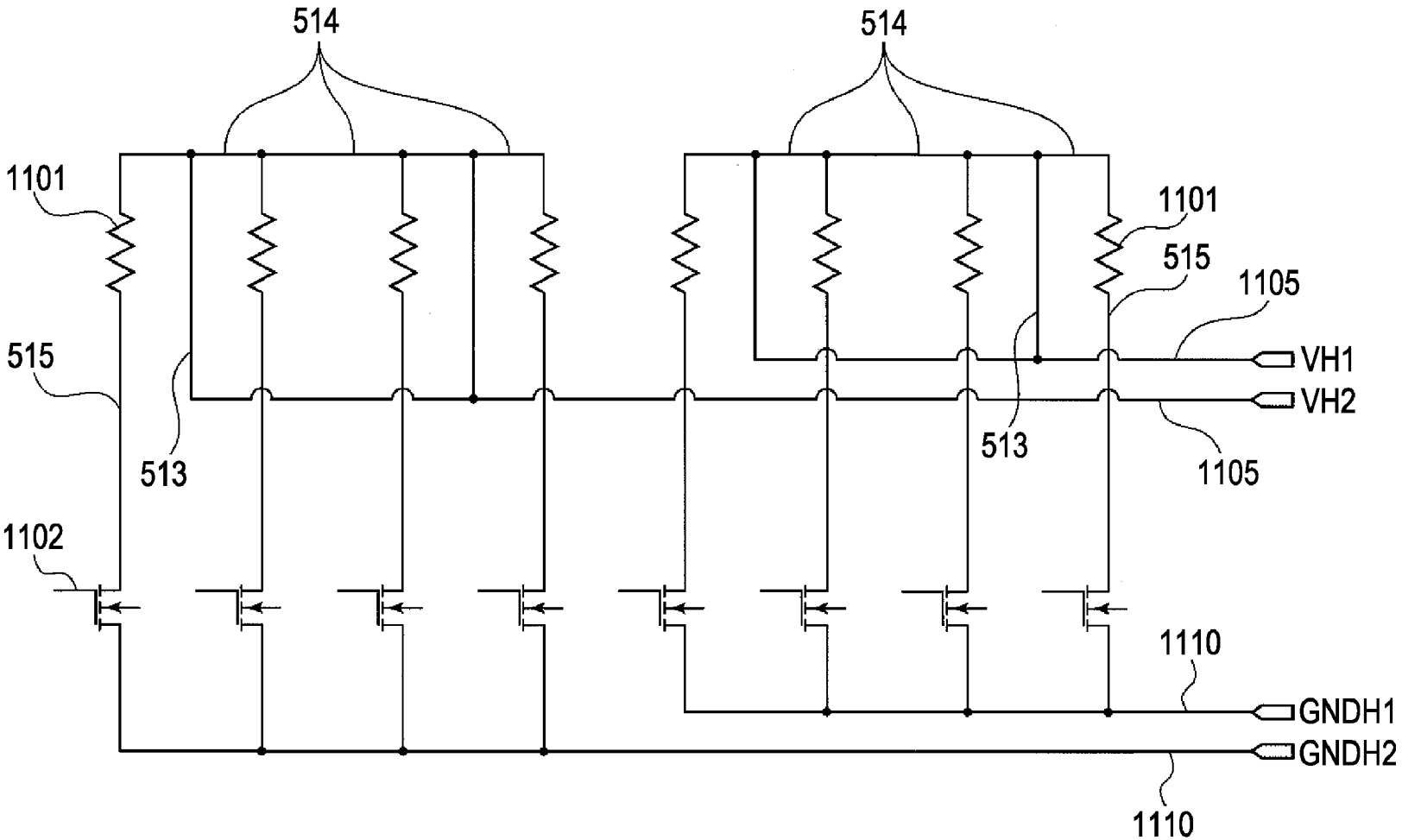
FIG. 4 is an electric circuit diagram corresponding to heaters and lines in FIG. 3.

FIG. 3 is a schematic plan view illustrating a heater arrangement in a printhead substrate according to a second exemplary embodiment of the present invention, and FIG. 4 is an electric circuit diagram corresponding to the arrangement of heaters 1101 and lines 513, 514 and 515 in FIG. 3. Similar components in FIGS. 3 and 4 to those in the above-described first exemplary embodiment are denoted by the same characters and a description of those components is not repeated here.

In the second exemplary embodiment of the present invention, as in the first exemplary embodiment, resistances constituting the heaters 1101 are formed in the same layer by using the multilayer wiring technique, and the lines 513, 514 and 515 are also formed in the same layer as the resistances. Further, as in the first exemplary embodiment, the return wirings 513 in each heater group are interconnected by the interconnecting wiring 514, which is formed between a heater array (row) and an ink supply port 1121 and which is extended substantially parallel to the lengthwise direction of the ink supply port 1121.

Also, in the second exemplary embodiment, the heaters in each heater group, which are interconnected by the interconnecting wiring, are not driven at the same time.

In the above-described first exemplary embodiment, all the heaters 1101 have the same shape. In the second exemplary embodiment, however, the heaters 1101 are formed as two differently-shaped heaters 1101A and 1101B having large and small sizes. The heaters 1101A are large-size heaters each discharging the ink in a relatively large amount Vd1, and the heaters 1101B are small-size heaters each discharging the ink in a relatively small amount Vd2. A discharge port 1132 corresponding to each of the large-size heaters 1101A is formed as a large discharge port having a relatively large opening area, and a discharge port 1132 corresponding to each of the small-size heaters 1101B is formed as a small discharge port having a relatively small opening area. Further, in the above-described first exemplary embodiment, the heaters 1101 and the return wirings 513 are formed in the same number, i.e., four, in one heater group. In the second exemplary embodiment, however, the number of the return wirings 513 is two in one heater group, as seen from FIG. 3. That feature is advantageous in setting a heater width (W1+W2) given by the sum of widths W1 and W2 of the heaters 1101A and 1101B to a larger value while ensuring a certain space 504 between the large-size heater 1101A and the small-size heater 1101B.

The number of the return wirings 513 to be arranged is set to a value at which the density of a current flowing through one return wiring 513 does not exceed a predetermined value and which is not too small. If the number of the return wirings 513 is too small, there arises a risk that an uneven distribution of the current density may occur in the heater group and a line resistance difference and a current difference may be caused depending on positions of the heaters 1101A and 1101B. Thus, the number of the return wirings 513 to be arranged in each heater group is set to a plural number that satisfies the above-described conditions.

The large-size heater 1101A with the ink discharge amount Vd1 has a square shape (18×18 μm) in a plan view with the width W1 and the length L1 being each 18 μm, and the small-size heater 1101B with the ink discharge amount Vd2 has a square shape (12×12 μm) in a plan view with the width W2 and the length L2 being each 12 μm. A heater pitch P1 for an area including the return wiring 513 is 23 μm and a heater pitch P2 for an area including the space 504 is 19 μm. By employing the wiring rules that specify a minimum line width to 2 μm and a minimum space width to 2 μm, the line width 501 of the return wiring 513 is set to 4 μm and the space width 502 is set to 2 μm. Further, the width of the space 504 between the heaters 1101A and 1101B is set to 4 μm. Accordingly, a ratio of the sum of the heater widths W1 and W2 to the sum of the pitches P1 and P2 (i.e., {(W1+W2)/(P1+P2)}) is 71.4%.

Thus, according to the second exemplary embodiment, the ink can be stably discharged and a high-quality image can be printed at a high speed while realizing a higher array density of the large-size heater 1101A and the small-size heater 1101B which correspond to the discharge ports having different ink discharge amounts.

Other Exemplary Embodiments

The present invention is not limited to only the above-described serial printing apparatus, and it can also be applied to, e.g., the so-called full-line printing apparatus using a long printhead which is extended over an entire printing area of a printing medium in the widthwise direction thereof. Therefore, the printhead substrate of the present invention can also be utilized to constitute a printhead used in the full-line printing apparatus. Any of the serial printing apparatus and the full-line printing apparatus is just required to include a mechanism capable of relatively moving the printhead and the printing medium.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-338095 filed Dec. 15, 2006, which is hereby incorporated by reference herein in its entirety.

What is claimed is:

1. A printhead substrate comprising:

an electrothermal transducer array in which a plurality of electrothermal transducers configured to generate energy to discharge ink are arranged;

a common line configured to commonly connect to the plurality of electrothermal transducers, the common line being provided on one side of the electrothermal transducer array;

a power supply line configured to supply electrical potential of a power source to the plurality of electrothermal transducers via a power supply terminal, the power supply line being provided on other side of the electrothermal transducer array;

a plurality of connect lines configured to connect the common line and the power supply line; and a ground line configured to supply ground potential to the plurality of electrothermal transducers via a ground terminal, the ground line being provided on the other side of the electrothermal transducer array.

2. The printhead substrate according to claim 1, wherein a film thickness of the common line is the same as a film thickness of the plurality of connect lines.

3. The printhead substrate according to claim 1, wherein the common line and the plurality of connect lines are provided by a single-layered conductive layer.

4. The printhead substrate according to claim 1, wherein the number of the plurality of electrothermal transducers is the same as the number of the plurality of the connect lines.

5. The printhead substrate according to claim 4, wherein the plurality of electrothermal transducers and the plurality of connect lines are provided so that each electrothermal transducer and each collect line are positioned alternately.

6. The printhead substrate according to claim 1, wherein the plurality of electrothermal transducers are positioned at equal spaces.

7. The printhead substrate according to claim 1, wherein the electrothermal transducer array is provided by alternately arranging a plurality of first electrothermal transducers and a plurality of second electrothermal transducers, the plurality of second electrothermal transducers being configured to generate energy to discharge ink of which droplets are different from droplets of ink discharged by energy generated by the plurality of first electrothermal transducers.

8. The printhead substrate according to claim 1, further comprising:

a plurality of transistors each provided corresponding to each of the plurality of electrothermal transducers, the plurality of transistors being configured to determine whether or not to supply currents to the plurality of electrothermal transducers in accordance with an input driving signal; and a driving circuit configured to output the driving signal in accordance with a data signal used commonly by the plurality of electrothermal transducers and a selection signal used to drive each of the plurality of electrothermal transducers at different timings.

9. A printhead comprising:

the printhead substrate according to claim 1; and a discharge port forming member with a plurality of discharge ports each corresponding to each of the plurality of electrothermal transducers.

10. A printing apparatus for printing an image on a printing medium by discharging liquid, comprising:

the printhead according to claim 9; and a mechanism arranged to relatively move the printhead and the printing medium.

* * * * *